United States Patent [19]

Walker

[11] 4,034,545

[45] July 12, 1977

[54] THREADING DEVICE AND METHOD FOR FALSE TWIST TUBES

[75] Inventor: Robert H. Walker, Greensboro, N.C.

[73] Assignee: Burlington Industries, Inc., Greensboro, N.C.

[21] Appl. No.: 656,588

[22] Filed: Feb. 9, 1976

[51] Int. Cl.[2] ..... D01H 17/00

[52] U.S. Cl. ..... 57/34 R; 57/77.33; 57/156; 81/3 R; 294/26

[58] Field of Search ..... 57/77.33, 77.35, 107, 57/112, 156, 34 R; 140/80; 81/3 J, 3 R; 294/1 A, 26

[56] References Cited

U.S. PATENT DOCUMENTS

| | | | |
|---|---|---|---|
| 760,619 | 5/1904 | Fredenburgh | 57/77.33 |
| 1,202,120 | 10/1916 | Stuckel | 294/26 |
| 2,604,350 | 7/1952 | Taylor | 294/26 |
| 3,145,041 | 8/1964 | Grolig | 294/26 X |
| 3,574,273 | 4/1971 | Hilbert | 57/77.33 X |
| 3,706,154 | 12/1972 | Luebbers et al. | 294/26 X |

*Primary Examiner*—Charles A. Ruehl
*Assistant Examiner*—Charles Gorenstein
*Attorney, Agent, or Firm*—Cushman, Darby & Cushman

[57] ABSTRACT

A threading tool for a quiet-running false-twist spindle of the type having a twist pin across the bore and no conventional threading slots or holes. The tool consists of a length of fine-gauge wire with an end for grasping and a second end having two hook-shaped bends in planes preferably substantially perpendicular to each other. Yarn is threaded quickly around the pin with six simple vertical and rotational motions of the tool. Mirror-image versions of the tool provide for S- or Z-twist as desired. The tool makes it practical to eliminate the whistling noise produced by high-speed spindles having threading slots or holes.

5 Claims, 14 Drawing Figures

THREADING DEVICE AND METHOD FOR FALSE TWIST TUBES

BACKGROUND AND SUMMARY OF THE INVENTION

The present invention relates to threading tools for the false-twist spindles of yarn texturing machines and, specifically, to a tool and its use for threading the pin of a spindle having no threading holes or slots.

Today's most common type of a false-twist spindle constitutes a C-shaped fixed housing with a small vertically mounted tubular element capable of rotation at speeds in the order of 500,000 to 600,000 rpm, together with means for transmitting rotational drive to said tubular element or "twist tube." This tube, with its associated twist pin, situated transverse to the axial bore, is itself commonly referred to as a false-twist spindle, and is so designated herein.

In U.S. Pat. No. 3,574,273 the history, characteristics, and particularly the threading problems of the pin type of spindle are discussed in great detail. Threading these spindles requires passing the thread-line up through the tube and taking one or more turns around the twist pin. Since an enclosed pin lying across the diameter of a simple cylinder is essentially inaccessible to threading, the art has resorted to various geometrical modifications of the spindle walls in the vicinity of the pin, notably in the form of notches, grooves, slots and drilled holes. U.S. Pat. No. 3,475,895 shows a simplified threading process which is made possible by the presence of carefully located drilled holes. Left unmentioned therein is the fact that the holes cause a whistling noise when the spindle is spun at high speed. U.S. Pat. No. 3,574,273 concerns itself with the same threading problem as that of applicant, that is, threading in the absence of holes or slots. Each of its two processes, however, suffers from the necessity to cut and tie ech threadline, which operations add greatly to the difficulty and time of performing each threadup. In comparison with this tedious prior method, the ease of using the present tool and process is particularly outstanding, and the tool thus makes it possible to secure the full advantages of quiet-running imperforate spindles on commercial false-twist texturing machines.

The present invention provides a pair of fine-gauge wire tools, one for S- and the other for Z-twist threadup, said tools being mirror images of each other, and a method of applying said tools to the thread-up of pin-type false-twist spindles. Each tool consists of a very fine-gauge but stiff section of wire having an elongated handle end and an opposite end having two bends. The intermediate ben is of comparatively large dimension relative to the bore of the spindle, while the bend at the end is smaller and preferably turned substantially at a right angle to the intermediate bend. The threadup of a yarn end is effected very easily by two pairs of down-and-up motions of the tool and one pair of rotational motions of either the spindle of the tool, without any cutting or tying of the yarn.

It is thus an object of the invention to provide a tool for threading the pin of an imperforate false-twist spindle or twist tube.

It is a further object to provide a rapid and easy method for using said tool to thread said pin.

It is a further object to make it commercially practical to secure the noise-reduction benefits of an imperforate spindle.

The foregoing and other objects and advantages will become apparent on considersation of the following description and accompanying drawings.

DETAILED DESCRIPTION OF THE INVENTION

Whether false-twist texturing will insert S- or Z-twist is determined solely by the direction of rotation of the false-twist spindle. It is well known, as discussed and illustrated in detail in aforementioned U.S. Pat. No. 3,574,273, hereby incorporated herein by reference as an aid to understsanding the present invention, that there is an optimal way to thread, i.e., wrap, the twist pin prior to starting the rotation, and that yarn breaks and other operating difficulties are encountered if threading is done in a different way, i.e., in an opposite direction.

In general terms, the yarn-threading tool of the invention comprises a first leg segment having a selected length, a second leg segment having a length that is less than said selected length of said first leg segment, said second leg segment extending from said first leg segment at an acute angle so as to form a first bend portion therebetween with said first and second leg segments lying in substantially the same plane, said second leg segment having a free end shaped to define a second hook portion which extends in a plane that is about 90° ± 45° and preferably substantially perpendicular to the plane defined by said first and second leg segments, said second hook extending generally toward the right of center in an S-twist tool and toward the left of center in a Z-twist tool when said tools are viewed with said second leg segment oriented in front of said first leg segment.

Figure 1:
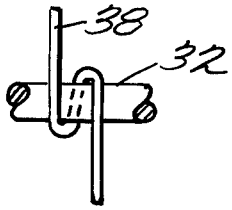
FIG. 1 is a diagrammatic view in elevation of the pin threadup required for optimum insertion of S-twist.
Figure 2:
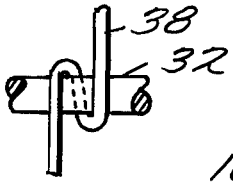
FIG. 2 is a corresponding view of the pin threadup for optimum insertion of Z-twist.

Referring now to the drawings, wherein like numerals designate corresponding parts throughout the several drawings, FIG. 1 schematically illustrates the optimal threaded position of yarn 38 on pin 32 for S-twist texturing, used in conjunction with subsequent clockwise spindle rotation, viewed from above the spindle. (All reference herein to direction of rotation are so oriented.) FIG. 2 illustrates the opposite threading, optimal for Z-twist texturing in conjunction with counterclockwise rotation. Each of these optimal threadings is easily and dependably achieved with the proper S- or Z-tool of the invention, applied as detailed hereinafter.

The generally conventional narrowing of the twist pin at its center (not shown in FIGS. 1 and 2) not only serves its usual purpose of keeping the yarn nearly centered at the axis of the spindle during texturing, but also affords more space for passing the tool and yarn between the pin and the surrounding wall during the process of the invention.

Utilization of the invention begins only after the yarn threadline has been conventionally passed or pulled up through the spindle, as with a long straight wire with a small gripping or pinching hook at its lower end, as described for example in U.S. Pat. No. 3,574,273.

Figure 3:
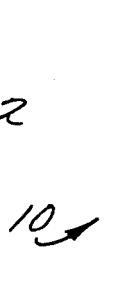
FIG. 3 is a diagrammatic view in elevation of the S-twist tool of the present invention.
Figure 4:
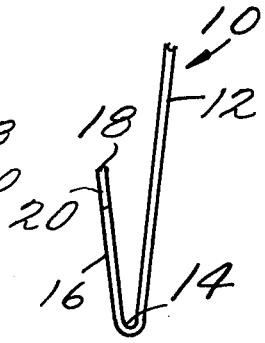
FIG. 4 is the right-side view of the S-twist tool of FIG. 3.

As illustrated in diagrammatic form in FIG. 3 and its right-side elevation, FIG. 4, the S-twist tool 10 of the invention typically comprises an unbroken length of fine-gauge wire having an elongated handle segment or leg 12 and an acute-angle bend 14 separating said handle segment from a shorter segment or leg 16 terminating in a substantially U-shaped hook 18. This hook preferably lies in a plane substantially perpendicular to the plane of bend 14 and its short leg 20 lies to the right of center when leg 16 is oriented vertically in front of leg 12, as in FIG. 3.

The dimensions of each tool are largely dictated by the dimensions and location of each type of spindle to be threaded. It is particularly essential that the tool be small enough to permit both its two legs and three cross-sections of yarn to be pulled simultaneously through one of the two openings between the pin and the wall of the spindle top. A stiff but still moderately springy material such as music wire is the most suitable material of construction. Actual dimensions of a tool for a specific spindle are given hereinafter. Although best suited to spindles with the pin located at the top, the tool and method may also be used to thread a pin located deeper in the spindle.

The angle of bend 14 is not critical, but typically is in the 10°–20° range. It should be small enough to permit easy insertion of the tool into the spindle, and large enough to permit the tool to be drawn up around the two sides of the pin at one stage in the threading operation. The springiness of the wire adds desirable adaptability to this angle; for instance, if a close-fitting tool is preferred, the angle may be made wide enough for the horizontal span of the tool legs at rest to be slightly greater than the spindle bore. Leg 16 should preferably be no longer than required, its actual length being determined principally by the need for hook 18 to protrude to a conventient distance above the spindle when bend 14 is pulled up around pin 32 during threadup. Leg 20 of hook 18 should preferably be only long enough to enclose the yarn snugly. The magnitude and significance of the optimal dimensions of the tool will be best comprehended in terms of the process of using it. Larger tool dimensions than are needed, although workable, generally only reduce the compactness and ease of the process steps.

Figure 5:
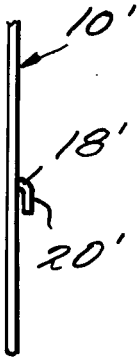
FIG. 5 is a corresponding view in elevation of the Z-twist tool of the invention.
Figure 6:
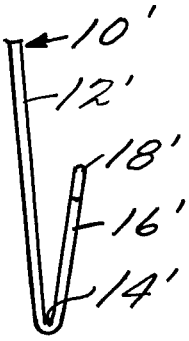
FIG. 6 is the right-side view of the Z-twist tool of FIG. 5.

The tool for optimal threading for Z-twist is the mirror image of that for S-twist. This is most evident from a comparison of FIG. 4 with FIG. 6 where the primed numbers designate corresponding parts described in connection with the S-twist tool. As with hook 18, hook 18' protrudes from the plane of the drawing. It will also be noted that short leg 20' lies to the left when leg 16' is oriented vertically in front of leg 12' of the Z-twist tool, which orientation is given by 180° rotation of FIG. 5 around its vertical axis. In FIG. 5, leg 16' is oriented behind leg 12' and thus short leg 20' lies to the right. FIGS. 3 and 5 depict convenient orientations of the tools at startup of the wrapping operation.

The pin-threading method of the invention is depicted diagrammatically in FIGS. 7–13, wherein are shown the preferred steps for correctly wrapping one turn of yarn around the twist pin in preparation for subsequent insertion of S-type false twist.

Figure 7:
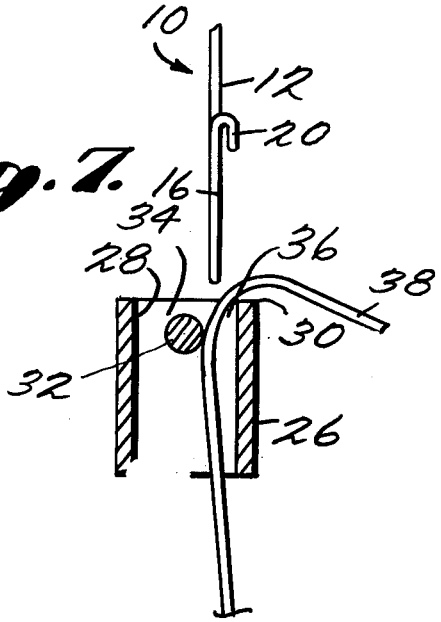
FIGS. 7–13 illustrate the steps of the threading method using the S-twist tool of the present invention.

In FIG. 7 the top portion of a false-twist spindle 26 is illustrated in section. The spindle top typically has a smooth-surfaced cylindrical internal bore 28 and adjacent its end 30 a twist-pin 32, together defining two openings 34 and 36 between the spindle wall and the pin. The method of the invention begins with yarn 38 having been pulled up through opening 36, with a convenient overhanging length of, for example, three to twelve inches of yarn comprising a free end above the spindle. Threading tool 10 is poised above opening 36 as shown.

Figure 8:
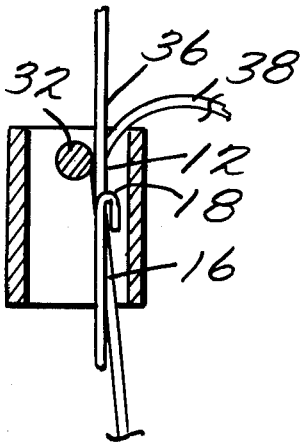

With yarn 38 generally held toward the rear of opening 36, tool 10 is inserted in front of the yarn such that handle leg 12 lies between the yarn and leg 16, and lowered until hook 18 lies below pin 32, as shown in FIG. 8.

Figure 9:
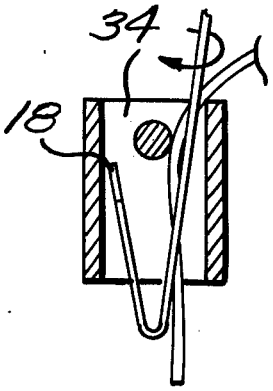

A 90° clockwise rotation of tool 10 brings hook 18 below and in line with opening 34, as shown in FIG. 9.

Figure 10:
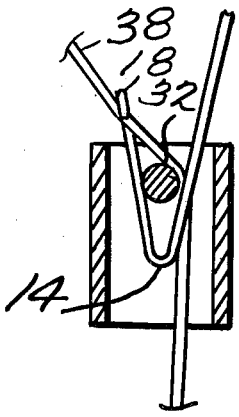

Tool 10 is next raised, thereby enclosing pin 32 in bend 14 and raising hook 18 into view above the spindle. Yarn 38 is thereupon brought over and laid into the hook, as shown in FIG. 10.

Figure 11:
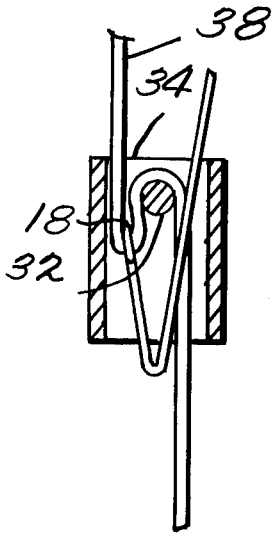

Tool 10 is next lowered again to its FIG. 9 position, thereby drawing a loop of yarn 38 in hook 18 into opening 34 and below pin 32, as shown in FIG. 11.

Figure 12:
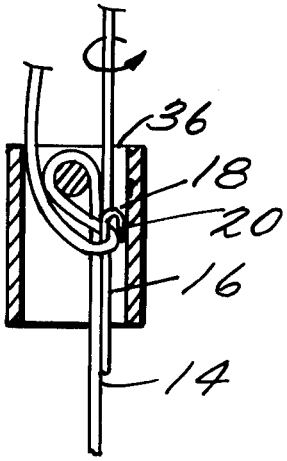

A 90° counterclockwise rotation of tool 10 next returns it to its FIG. 8 position, thereby placing the yarn loop, still held in hook 18, below opening 36, as shown in FIG. 12.

Figure 13:
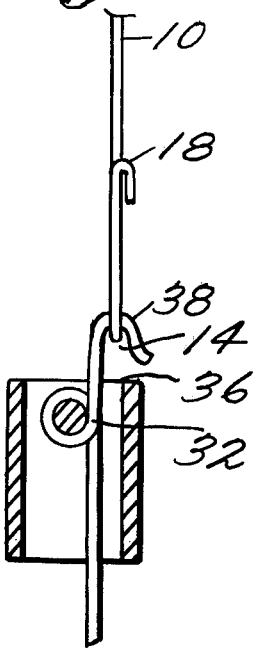

Finally, tool 10 is withdrawn upwards through opening 36, during which action the loop of yarn slips from hook 18 and is caught and drawn up by bend 14, thereby completing a full turn of yarn around pin 32 and leaving the end of yarn 38 free for passing to windup, as shown in FIG. 13, after the tool is disengaged.

In this final step of the invention process, both hook 18 and the two legs of the tool, together with three thicknesses of yarn, must be able to pass simultaneously through opening 36.

In common with prior art processes, if the spindle opening is large enough and/or the yarn small enough to provide clearance, a second or more turns of yarn around the pin may be repeating the foregoing sequence of actions, beiginning with FIG. 7. The only limitation on the number of turns which could be inserted is the size of opening 36.

One of ordinary skill will readily see in FIG. 12 the reason why a Z-twist tool cannot thread for S-twist texturing by the preferred series of operations, and vice versa. In FIG. 12 the yarn, besides being enclosed by hook 18, forms a loop around leg 16. With proper care the yarn could have been brought to substantially this point in the process by applying the aforesaid sequence of operations with the Z-twist tool of the invention. The yarn loop would, however, be around leg 20 of hook 18 instead of leg 16. It is obvious that the moment the attempt is made to withdraw the yarn upwards through opening 36, the loop will slip down leg 20 without being caught by bend 14, and wrapping of the pin will have failed. No lengthening of leg 20 could avert this failure.

The process has been described in terms of passing the yarn and the tool through opening 36, with pin 32 endwise to the operator. It is obvious that other orientations of the various components are equivalent, and fall within the scope of the invention process. For example, a left-handed operator might prefer to insert the yarn and tool on the left-hand side of the pin, with the yarn to the front, and adapt his subsequent maneuvers accordingly. It is further obvious that the 90° turns of the tool as depicted in FIGS. 9 and 12 (first clockwise and then counterclockwise) could be substituted, at the preference of the operator, by 90° counterclockwise and clockwise turns of the spindle, while holding the tool steady, without departing from the scope of the invention. It is generally preferable and most practical to effect the threading operation with each spindle tube in place on the texturing machine, but if desired the spindle could be removed and corresponding up-and-down motions of it substituted for the aforesaid tool movements.

The preferred mode operation of the Z-threading mirror-image tool of the invention will be readily evident to one of ordinary skill in the light of the foregoing description of S-threadup. The process starts with Z-tool 10' of FIG. 5 behind the yarn and above opening 36 as in FIG. 7. The subsequent movements of the tool are essentially the same as before, except that the yarn is held toward the front of opening 36 while the Z-tool is lowered behind the yarn such that handle leg 12' lies between the yarn and leg 16', a mirror image position to that of FIG. 8. The turn of the Z-tool corresponding to FIG. 9 is counterclockwise, and the return motion corresponding to FIG. 12 is clockwise. The vertical movements of the tool are the same as with S-wrapping, with hook 18' extending or opening to the rear. The final result is a wrap of the pin according to FIG. 2.

Despite the strong preference expressed for the sequence of threading operations hereinbefore described, as well as for the use of separate S- and Z-twist tools, it is recognized that it is possible to insert a Z-twist wrap with the S-twist tool, and vice versa. The maneuvers whereby this may be effected are, however, more difficult and the possibility of failure greater than when each tool is put to its preferred use. As an example of these less advantageous manipulations, referring to FIG. 8, the S-twist tool may be inserted into the spindle behind instead of in front of the yarn (but with obvious risk of entangling leg 20 of hook 18 in the multifil yarn). Counterclockwise rotation, raising, and lowering will bring the tool to the position of FIG. 11, but with the yarn in front of leg 12. From this point at least two routes exist for completing a Z-twist wrap of conditions are just right. In the first of these, highly dependent upon there being sufficient free space in the spindle, it is possible by counterclockwise rotation of the tool to pass hook 18 with its enclosed loop of yarn behind the yarn segment coming up from below, which will lead to a Z-twist wrap when the tool is raised to the FIG. 13 position. In a second alternative route, also starting from the modified FIG. 11 position, the S-twist tool is rotated clockwise to an essentially FIG. 12 position, but with the yarn loop behind the yarn segment rising from below. At this point the yarn is looped around short leg 20. If the tool is then thrust an inch or so deeper into the spindle, with both ends of the yarn held taut, the loop of yarn will slip back into the curve of hook 18, which point it can usually be induced to slide down leg 12 by holding the free end of yarn taut while the tool is finally raised to the FIG. 13 position, thereby completing a Z-twist wrap. Obviously the deep thrusting of the tool may precede the clockwise rotation to achieve the same final result.

Other possible, but generally more difficult and less dependable manipulations of the tools are believed to fall within the scope of the invention.

As depicted in the drawings and discussed hereinbefore, in both the S- and Z-tools the plane of hook 18 preferably lies substantially perpendicular to the plane of bend 14. This right-angle relationship between hook 18 and bend 14, although preferred, is not essential. With reference to FIG. 4, wherein leg 20 lies directly in front of leg 16, hook 18 may be turned as much as about 45° to the right or left such that its plane lies about 90°±45° to the plane of bend 14, without substantial loss of functionality in the process of the invention. In this connection, with reference to FIG. 10, it is obvious that the insertion of yarn 38 into hook 18 is easiest to accomplish and retain when the planes of hook 18 and bend 14 lie substantially perpendicular to each other.

A slight refinement of tool 10 which substantially improves its operability is readily understood from consideration of FIG. 7. As depicted therein, short leg 20 extends to the right and obviously runs some risk of snagging on the top rim of the spindle when subsequently lowered into it. Either bending leg 16 or twisting bend 14 slightly to the left in the plane of the drawing places leg 20 substantially in line with handle leg 12 and whereby decreases its tendency to snag on the spindle rim. This refinement is incorporated into the working tool of FIG. 14.

The tools of this invention have hereinbefore been presented in diagrammatic and enlarged form as an aid to understanding. As will be evident to one experienced in the art of false-twist texturing, the particular environment and features of the texturing machine upon which the false-twist spindle is mounted will almost inevitably influence the optimal shape of the handle end of the threading tool. On Leesona Model 550, 553, and 555 texturing machines, for instance, the presence of a pigtail guide just above the spindle interferes to some degree with the insertion and manipulation of a threading tool having a completely straight handle end. Further, it is generally an aid to using the tool to fit it with a simple wood or plastic handle, and to stiffen that portion of the wire which need not enter the bore of the spindle.

Figure 14:
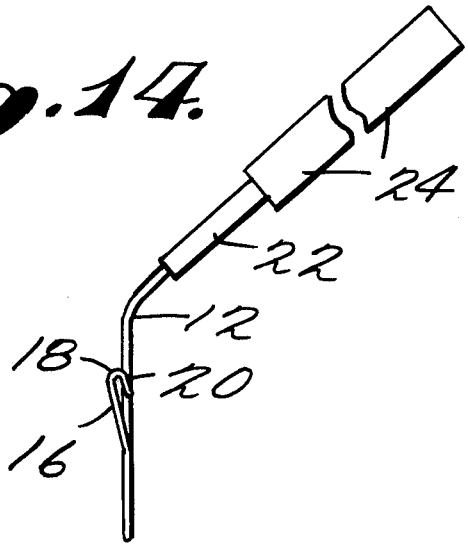
FIG. 14 is a view in elevation, corresponding to FIG. 3, of a working S-twist tool of the invention.

A working tool embodying these various considerations and specifically suited to threading of spindles of a Leesona 553 machine is detailed in FIG. 14, the positioning thereof corresponding to that of FIG. 3. The complete tool comprises a working section of 12-mil guiter string, a stiffening section made from a hypodermic needle, and a handle section of ⅜-inch wooden dowel. Hook 18 has a 1/32-inch outside curvature and a 1/16-inch leg 20 and is tilted toward the left by slight bending of ⅜-inch leg 16. Leg 12, having ¾-inch of exposed length, is bent near its upper end to form an approximately 135° angle both in and backwards into the plane of the drawing, to minimize conflict with a pigtail guide fixed just above the spindle exit. The extreme upper end of the wire is snugly encased in a section of hypodermic needle 22, which in turn protrudes ½-inch from a 2-inch length of wooden handle 24. It is generally most suitable to bulk-manufacture the tool with only bends 14 and 18, and to leave it to each individual operator to insert the other bends to suit his own preference and machine environment.

Although described herein in terms of Leesona false-twist machines, the tool of the invention may be readily constructed to fit the needs of a wide range of pin-type spindles and texturing machines, such as those of ARCT, Barmag, FAG, Heberlein, Scragg and other origin. As noted before, the size of the opening between the pin and the wall of the spindle is the chief limit on the scope of utility of the invention.

What is claimed is:

1. A yarn threading tool for threading a false-twist spindle of the type having a bore and a twist pin mounted in said bore with said twist pin extending transversely with respect to said bore, said tool comprising a first leg segment having a selected length, a second leg segment having length that is less than said selected length of said first leg segment, said second leg segment extending from said first leg segment at an acute angle so as to form a yarn retaining bend portion therebetween with said first and second leg segments lying in substantially the same plane, said second leg segment having a free end shaped to define a yarn catching hook portion which extends in a plane that is about 90°±45° to the plane defined by said first and second leg segments.

2. The yarn threading tool as claimed in claim 1 wherein said hook portion on said free end of said second leg segment extends in a plane that is substantially perpendicular to the said plane defined by said first and second leg segments.

3. The yarn threading tool as claimed in claim 1 wherein said first and second leg segments are formed integrally from wire which is bent intermediate its ends to define said bend portion and is bent at its free end to define said hook portion.

4. The yarn threading tool as claimed in claim 1 wherein said second leg segment is bent at a point intermediate said free end and said bend portion to extend at an angle relative to said plane defined by said first and second leg segments.

5. A method of threading yarn on a yarn twisting device of the type having a tube having a bore and a twist pin fixed in said bore with a tool having a bend portion between two leg segments of said tool and a hook formed at the end of one of said leg portions, the steps comprising:

a. passing the yarn completely through the bore of said tube,
b. inserting said tool into said bore until said hook passes said twist pin,
c. rotating said tool to dispose one leg on one side of said pin and the other leg on the other side thereof,
d. withdrawing said tool to expose said hook,
e. looping the yarn on said hook,
f. reinserting said tool until said hook passes said twist pin,
g. rotating said tool to dispose both legs thereof on the same side of said twist pin, and
h. withdrawing said tool from said bore with yarn carried by said bend portion of said tool.

* * * * *

UNITED STATES PATENT OFFICE

CERTIFICATE OF CORRECTION

Patent No. 4,034,545 Dated July 12, 1977

Inventor(s) Robert H. Walker

It is certified that error appears in the above-identified patent and that said Letters Patent are hereby corrected as shown below:

Column 1, line 39, delete "ech" and substitute therefor --each--.

Column 2, line 29, delete "understsanding" and substitute therefor --understanding--.

Column 2, line 58, delete "reference" and substitute therefor --references--.

Column 3, line 44, delete "conventient" and substitute therefor --convenient--.

Column 4, line 46, delete "may be repeating" and substitute therefor --may be made by repeating--.

Column 4, line 47, delete "beiginning" and substitute therefor --beginning--.

Column 5, line 16, delete "mode operation" and substitute --mode of operation--.

Column 5, line 48, delete "Z-twist wrap of" and substitute --Z-twist wrap if--.

UNITED STATES PATENT OFFICE

CERTIFICATE OF CORRECTION

Patent No. 4,034,545 Dated July 12, 1977

Inventor(s) Robert H. Walker

It is certified that error appears in the above-identified patent and that said Letters Patent are hereby corrected as shown below:

Column 5, line 63, delete "which point" and insert in place thereof --from which point--.

Column 6, line 51, delete "guiter" and substitute therefor --guitar--.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*